US008651508B2

(12) United States Patent
Woodhouse

(10) Patent No.: US 8,651,508 B2
(45) Date of Patent: Feb. 18, 2014

(54) PORTABLE DOCK SYSTEM

(76) Inventor: Preston Woodhouse, Fairford (CA)

( * ) Notice: Subject to any disclaimer, the term of this patent is extended or adjusted under 35 U.S.C. 154(b) by 886 days.

(21) Appl. No.: 12/782,339

(22) Filed: May 18, 2010

(65) Prior Publication Data

US 2010/0296874 A1 Nov. 25, 2010

Related U.S. Application Data

(60) Provisional application No. 61/179,440, filed on May 19, 2009.

(51) Int. Cl.
*B60P 3/10* (2006.01)
*B63C 13/00* (2006.01)

(52) U.S. Cl.
USPC ..... 280/414.1; 280/414.3; 114/344

(58) Field of Classification Search
USPC ..... 280/414.1, 414.3; 405/219, 195.1, 218; 414/137.1, 137.7, 137.8, 137.9, 138.7, 414/138.4, 139.2, 140.1, 678, 803; 114/362, 263, 344
See application file for complete search history.

(56) References Cited

U.S. PATENT DOCUMENTS

| | | | | | |
|---|---|---|---|---|---|
| 2,608,314 | A | * | 8/1952 | Krider | 414/531 |
| 3,608,754 | A | * | 9/1971 | Park | 414/534 |
| 3,720,967 | A | * | 3/1973 | Rice | 114/344 |
| 4,092,755 | A | | 6/1978 | Hughes | |
| 4,099,279 | A | * | 7/1978 | Park | 114/344 |
| 4,225,280 | A | * | 9/1980 | Brunet et al. | 414/479 |
| 4,505,619 | A | | 3/1985 | Sargent | |
| 4,858,943 | A | * | 8/1989 | Cote | 280/414.1 |
| 5,013,206 | A | * | 5/1991 | Ernst et al. | 414/483 |
| 5,165,706 | A | * | 11/1992 | Fond | 280/414.1 |
| 5,228,713 | A | * | 7/1993 | Kovach | 280/414.1 |
| 5,332,249 | A | * | 7/1994 | Solberg et al. | 280/414.1 |
| 5,468,115 | A | * | 11/1995 | Alvis | 414/556 |
| 6,257,167 | B1 | * | 7/2001 | Joaquim | 114/344 |
| 7,503,274 | B2 | * | 3/2009 | Weed et al. | 114/45 |
| 2009/0072514 | A1 | * | 3/2009 | Hyslop | 280/414.1 |

* cited by examiner

*Primary Examiner* — Paul N Dickson
*Assistant Examiner* — Daniel Yeagley
(74) *Attorney, Agent, or Firm* — Kyle R. Satterthwaite; Ryan W. Dupuis; Ade & Company Inc.

(57) ABSTRACT

A portable trailer dock system features a floating dock assembly pivotally mounted atop a trailer frame to allow elevating of a free end of the floating dock assembly above the corresponding distal end of the trailer opposite the towing end thereof so that the dock can be held above the water surface when the trailer is backed into a body of water to temporarily install the dock thereat. In another embodiment, the connection between the dock and trailer is releasable to allow floating of the dock further out over the water. Another embodiment features a cover disposed over an a-frame neck of the trailer and a pair of extensions pivotally mounted to opposite sides of the neck for selective pivoting into deployed positions cooperating with the a-frame cover to form a walkway between the dock and the towing vehicle.

9 Claims, 10 Drawing Sheets

PORTABLE DOCK SYSTEM

This application claims benefit under 35 U.S.C. 119(e) of U.S. Provisional Patent Application Ser. No. 61/179,440, filed May 19, 2009.

FIELD OF THE INVENTION

The present invention relates generally to portable dock systems featuring a floatable dock assembly carried on a wheeled trailer.

BACKGROUND OF THE INVENTION

It is known in the art to provide a portable dock in the form of a dock structure carried on a vehicle-towed trailer so that the dock can be used at different locations by towing the trailer to the desired site. U.S. Pat. No. 4,092,755 of Hughes and U.S. Pat. No. 4,505,619 of Sargent teach such dock and trailer combinations. However, the trailer of each of these references is intended not only to support and transport the dock, but also to transport a boat upon the same trailer unit. As a result, the trailer and dock combinations of these two references each include features that, while useful in their intended context of towing a boat behind a towing vehicle and subsequently launching the boat at a site where the dock is to be temporarily installed, may be less than desirable in other contexts, such as using the dock for a canoe or kayak launch where a dedicated boat trailer is typically not required or using the dock simply for swimming or fishing purposes.

For example, the dock trailer of Hughes appears to be intended to sink below the surface of the water when backed into the body of water so that the boat can then be launched off the bunks carried atop the deck of the dock structure. In one embodiment, the dock therefore relies on vertical anchor bars or stilts mounted to rear corners of the trailer dock to subsequently carry the weight of the deck above the surface of the water after launching of the boat. The wheels of the trailer disrupt the sea bed floor during entry of the trailer into the water, and the anchor bars then subsequently disrupt additional areas of the sea bed. It would be desirable to reduce this disruption for minimal ecological impact.

In another embodiment, the sinking and floating of the dock needed for loading of the boat and use of the dock, respectively, is controlled through filling and draining of floatation tubes with water, as they float when filled with air but sink when filled with water. This requires removal and installation of multiple plugs on multiple flotation tubes and draining water from the tubes for replacement with air can only be achieved by removal of the water filled tubes from the body of water. Furthermore, lowering of the deck beneath the surface of the water for launching of the boat wets the deck surface, making it potentially slippery and hazardous for users. It would be desirable to provide a trailer carried dock that is easily preparable for floating and/or is deployable without submersion of the deck surface in the body of water.

Sargent's trailer and dock combination features only very narrow walkways so as not to interfere with the significant trailer area required for carrying the boat on the trailer. Walkways are pivotally carried at a rear end of the trailer to fold outward therefrom for use after launching of the boat. A winch is used in conjunctions with a cable assembly to pull the walkways back into their storage position after use. The cable run above the walkways, and thus are either installed only when needed and subsequently removed or carefully navigated around when using the walkways. In a dock structure pivotally mounted on a trailer frame, it would be desirable to be able to control the dock's pivotal motion without cables interfering with safe use of the dock or limiting the useful area thereof.

Also, neither reference provides for a person's easy transition from the truck bed or cargo hold of the towing vehicle to the dock carried on the trailer, as one would either need to step down from the towing vehicle to the ground then walk to and step back up onto the dock or carefully step down onto and balance upon a narrow trailer frame member at the towing end thereof to walk to the dock carrying rear portion of the trailer, thereby risking a fall and possible resulting injury. It would be desirable to provide a portable dock system that provides a transition walkway from the towing vehicle to the dock for direct and safe walking from the two vehicle to the dock.

In view of the forgoing shortcomings of the prior art, there is room for improvement in portable dock systems.

SUMMARY OF THE INVENTION

According to a first aspect of the invention there is provided a portable dock system comprising:

a trailer frame extending in a longitudinal direction between proximal and distal ends;

a coupling component mounted to the trailer frame proximate the proximal end thereof for selective coupling of the trailer frame to a tow vehicle;

a pair of wheel assemblies mounted to the trailer frame between the proximal and distal ends at a distance from the proximal end to rollably support the trailer frame for towing by thereof by the towing vehicle;

a dock assembly carried on the trailer frame and comprising a deck surface extending in the longitudinal direction above the trailer frame from a pivot end of the dock assembly adjacent the proximal end of the trailer frame to an opposite free end of the dock assembly adjacent the distal end of the trailer frame, the pivot end of the dock assembly being pivotally mounted to the trailer frame for pivotal movement about an axis transverse to the trailer frame to allow lifting and lowering of the free end of the dock assembly relative to the trailer frame;

floats mounted on the dock assembly below the deck surface thereof to float the dock assembly under entry of the floats into a body of water.

Preferably there is provided a lift control winch mounted on the trailer frame adjacent the proximal end thereof, at least one upright mounted on the trailer frame between the lift control winch and the distal end of the trailer frame at a distance from the lift control winch along the longitudinal direction, and a lift line extending from the lift control winch, passing over a line support on each upright and extending downward from the line support to a respective lift connection with the dock assembly so as to lift and lower the free end of the dock assembly relative to the trailer frame under rotation of the lift control winch in opposite directions.

Preferably the lift line passes under the dock assembly between the lift control winch and the at least one upright.

Preferably the lift line extends below the assembly from the pivot end thereof to the at least one upright.

Preferably the at least one upright comprises two uprights mounted to the trailer frame on opposing sides of the dock assembly.

Preferably the lift line comprises a first line section fixed to the lift control winch and second line sections fixed to an end of the first line section opposite the lift control winch and diverging outward therefrom toward the uprights on the opposing sides of the dock assembly.

Preferably the at least one upright is positioned at a location of the wheel assemblies along the longitudinal direction, the wheel assemblies carrying at least one line guide about which the lift line extends from below the dock assembly to the line support of each upright.

Preferably each line guide is mounted to a connector that interconnects a suspension member of a respective one of the wheel assemblies to an axle of the wheel assemblies.

Preferably the pivotal end of the dock assembly is releasable from the trailer frame.

Preferably there is provided a tether control winch mounted on the trailer frame and a tether line extending between the tether control winch and a tether connection on the dock assembly, release of the pivot end of the dock assembly from the trailer frame when the trailer is deployed into a body of water to float the dock assembly thereon allowing deployment of the dock assembly away from the proximal end of the trailer and rotation of the tether control winch facilitating retraction of the dock assembly back toward the proximal end of the trailer frame after.

Preferably there is provided a tether guide mounted to the trailer frame at a position that is nearer to the distal end of the trailer frame than the tether control winch and also nearer to the distal end of the trailer frame than the tether connection is when the pivotal end of the dock assembly is secured to the trailer frame, the tether line being removably engagable about the tether guide to change a pulling direction in which the tether connection would be pulled by rotation of the tether control winch in a single rotational direction when the tether connection is situated between the tether control winch and the tether guide in the longitudinal direction.

Preferably the tether guide is realeasably mounted to the trailer frame for selective installation in an operational position thereon.

Preferably the trailer frame comprises an a-frame neck that defines the proximal end thereof and comprises two side members converging toward the proximal end and an a-frame cover mounted over the two side members to cover space defined between the two side members, and wherein two extensions are pivotally mounted on the two side members of the a-frame neck and are pivotal between deployed positions projecting outward from the side members of the a-frame neck in orientations parallel to the a-frame cover and stowed positions projecting inward from side members of the a-frame cover over the a-frame cover.

Preferably the extensions are right angle triangles that cooperate with the a-frame cover in the deployed positions define a rectangular walkway between the proximal end of the trailer frame and the pivotal end of the dock assembly.

Preferably the extensions comprise flat pieces of mesh pivotally secured to the a-frame neck of the trailer frame.

Preferably a-frame cover comprises mesh material mounted atop the a-frame neck of the trailer frame.

Preferably there are provided stop elements defined between the extensions and the a-frame neck to block pivoting of the extensions past the deployed positions from the stowed positions.

According to a second aspect of the invention there is provided a portable dock system comprising:

a trailer frame extending in a longitudinal direction between proximal and distal ends;

a coupling component mounted to the trailer frame proximate the proximal end thereof for selective coupling of the trailer frame to a tow vehicle;

a pair of wheel assemblies mounted to the trailer frame between the proximal and distal ends at a distance from the proximal end to rollably support the trailer frame for towing by thereof by the towing vehicle;

a dock assembly comprising a deck surface mounted on a plurality of floats to float the dock surface over a body of water when the dock assembly is placed thereon, the dock assembly further comprising a releasable connection to the trailer frame to facilitate placement of the dock assembly on the water while attached to the trailer frame at the releasable connection and subsequent floating of the dock away from the proximal end of the trailer further out over the body of water when disconnected from the trailer frame at the releasable connection.

Preferably there is provided a tether connection between the trailer frame and the dock assembly to limit a distance of separation between the dock assembly and the trailer frame when disconnected from one another at the releasable connection.

Preferably the tether connection comprises a tether line connected between the dock assembly and a tether control device, the tether control device being operable to retract the dock assembly back toward the proximal end of the trailer frame for reconnection thereto.

Preferably the tether control device is additionally operable to deploy the dock assembly away from the proximal end of the trailer frame after initial disconnection of the releasable connection.

According to a third aspect of the invention there is provided a portable dock system comprising:

a trailer frame extending in a longitudinal direction between proximal and distal ends and comprising an a-frame neck that defines the proximal end of the trailer and comprises two side members converging toward the proximal end;

a coupling component mounted to the trailer frame proximate the proximal end thereof for selective coupling of the trailer frame to a tow vehicle;

a pair of wheel assemblies mounted to the trailer frame between the proximal and distal ends at a distance from the proximal end to rollably support the trailer frame for towing by thereof by the towing vehicle;

a dock assembly carried on the trailer frame and comprising a deck surface extending in the longitudinal direction above the trailer frame an a-frame cover mounted over the two side members of the a-frame neck of the trailer frame to cover space defined between the two side members; and two extensions that are pivotally mounted on the two side members of the a-frame neck and are pivotal between deployed positions projecting outward from the side members of the a-frame neck in orientations parallel to the a-frame cover to define a walkway between the dock assembly and the proximal end of the trailer frame and stowed positions projecting inward from side members of the a-frame over the a-frame cover.

BRIEF DESCRIPTION OF THE DRAWINGS

In the accompanying drawings, which illustrate a exemplary embodiments of the present invention.

DETAILED DESCRIPTION

Figure 1:
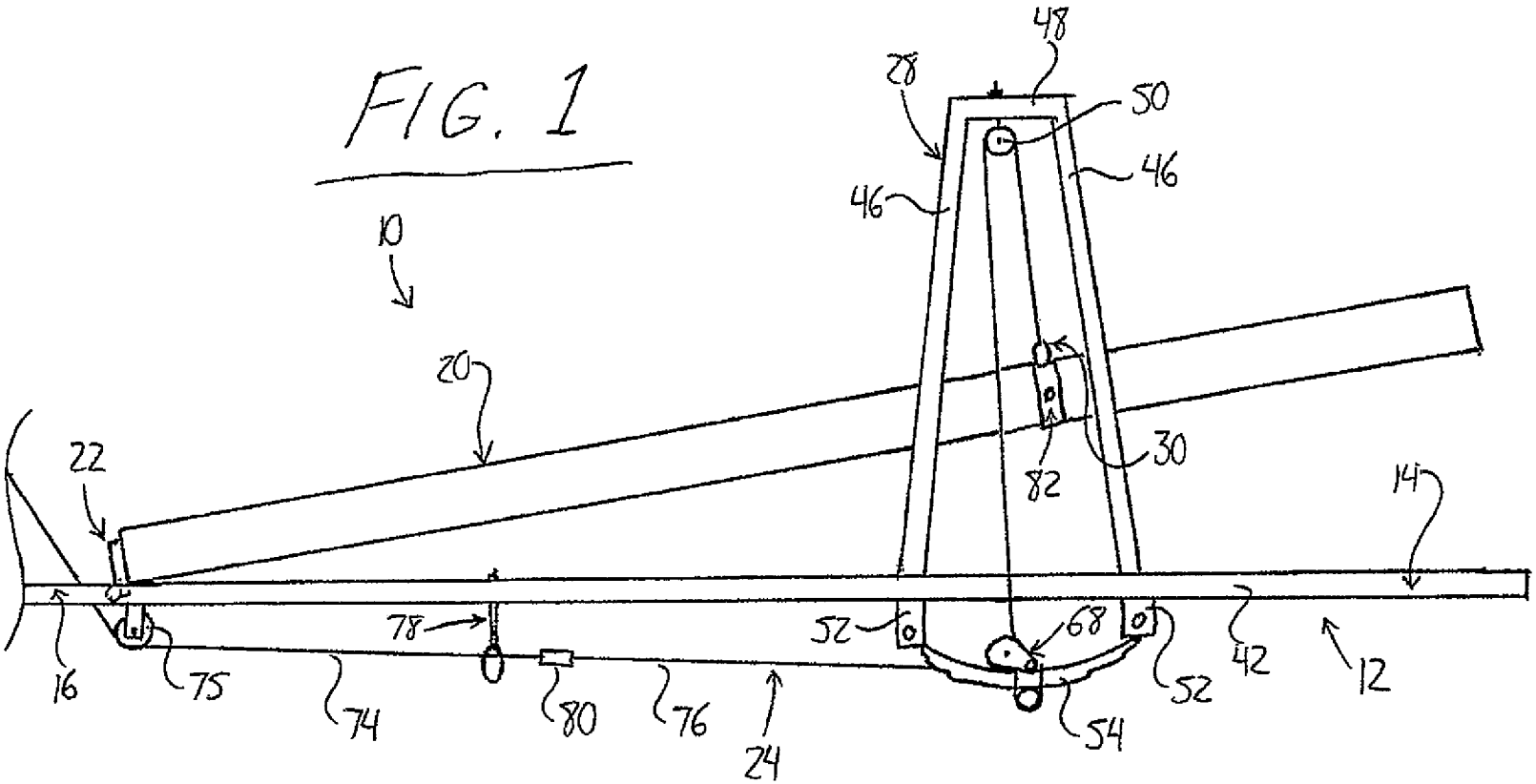
FIG. 1 is a schematic side elevational partial view of a first embodiment portable dock system featuring a floatable dock assembly pivotally mounted atop a trailer frame, with details of the trailer's wheel assemblies omitted for illustrative purposes.
Figure 4:
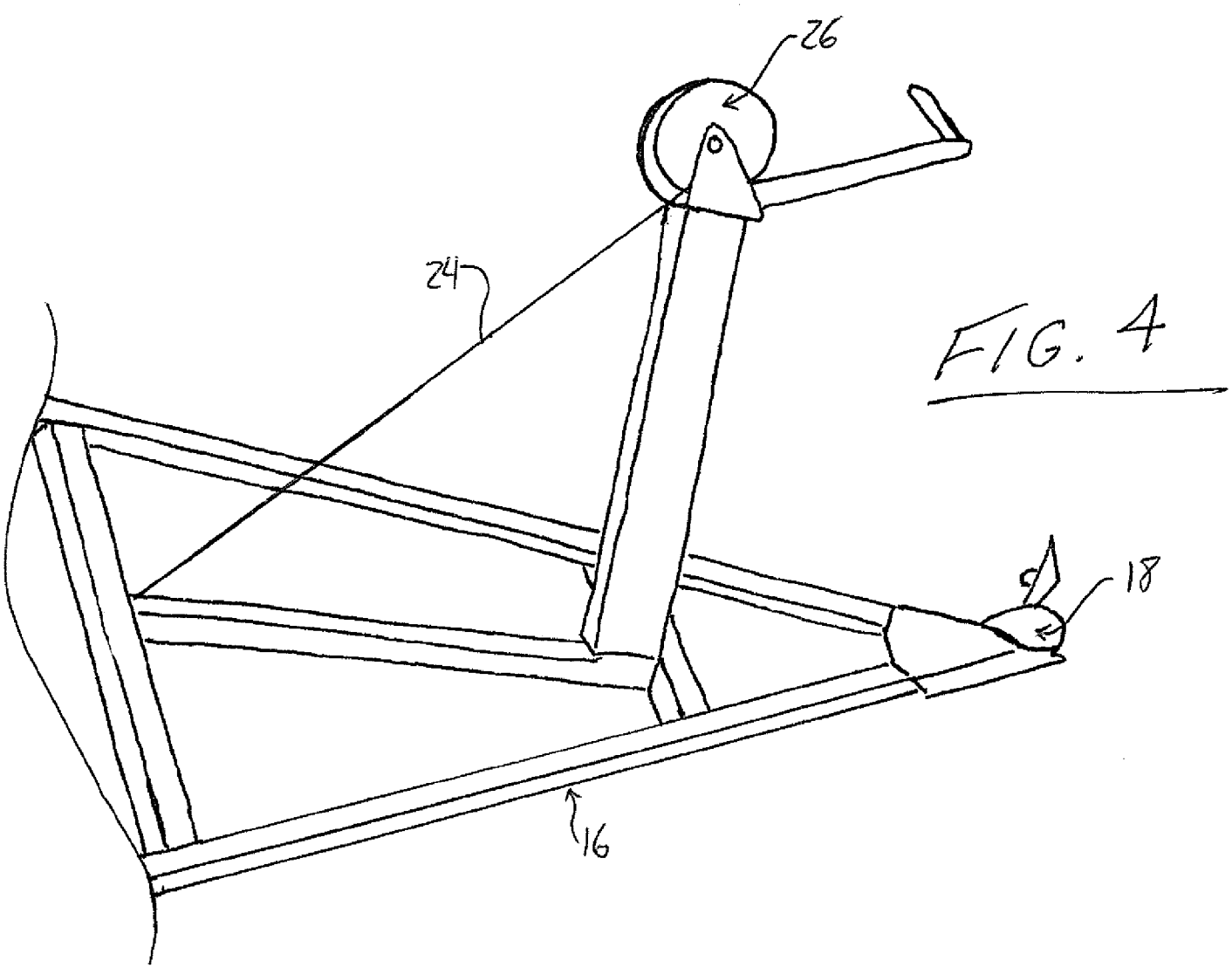
FIG. 4 is a schematic perspective view an a-frame neck of the trailer frame supporting a winch operable to control pivoting of the dock assembly through the lift cable assembly.

FIG. 1 shows a portable dock system 10 that features an elongate trailer 12 having a main or primary rectangular frame 14, the length of which defines a longitudinal direction in which the trailer 12 is to be pulled by a tow vehicle. From one end of the primary frame 14 projects an a-frame neck 16 of the trailer (FIG. 4) defining a proximal end of the trailer at which a trailer hitch component 18 is mounted to defined a socket matable with a hitch ball of the towing vehicle in a conventional manner. A rectangular dock platform assembly 20 has a width generally equal to or slightly less than that of the primary trailer frame 14 and a length spanning substantially, if not all, of the full length thereof. A hinge assembly 22 connects one end of the dock assembly 20 to the primary trailer frame 14 at the end thereof adjacent the a-frame trailer neck 16 so that the dock assembly 20 is vertically pivotal relative to the trailer 12 about an axis perpendicularly transverse to the trailer 12.

A lift cable assembly 24 is fixed at one end to a lift control winch 26 carried on the a-frame neck 16 of the trailer 12 at a fixed distance thereabove to pass under the pivot end of the dock assembly 20 to a pair of uprights 28 projecting upward from the primary trailer frame 14 on opposite sides thereof at positions nearer the opposite distal end thereof, where the cable assembly is guided upward past the dock assembly and then back down to a connection 30 thereto. Turning the lift control winch 26 in a tensioning or pulling direction wrapping more of the cable about its drum lifts a free end of the dock assembly opposite the pivot end upwardly away from the primary trailer frame 14 upon which the dock assembly 20 would otherwise sit under the effect of the dock assembly's weight about the pivot axis. As a result of this arrangement, the dock assembly can be pivoted to lift its distal end off the primary trailer frame 14 before backing the trailer 12 along a decline into a body of water. Pivoted upward off the trailer frame a sufficient amount, the dock assembly, or at least the upper deck surface thereof, remains above the surface of the body of water as the primary frame 14 of the trailer is backed into the body of water. Once the trailer is in a desirable position and the tow vehicle is accordingly stopped, the free end of the dock assembly can then be gently lowered down onto the surface of the water to carry the top deck surface of the dock assembly above the water for walking thereon through controlled release of a length of the lifting cable assembly from the lift control winch 26. Through this process, the deck remains dry during the installation of the dock assembly as a temporary dock, as it is never submerged into the body of water.

Further details of the structure of the first embodiment portable dock system of FIGS. 1 to 7 are now described as follows.

Figures 5, 6:
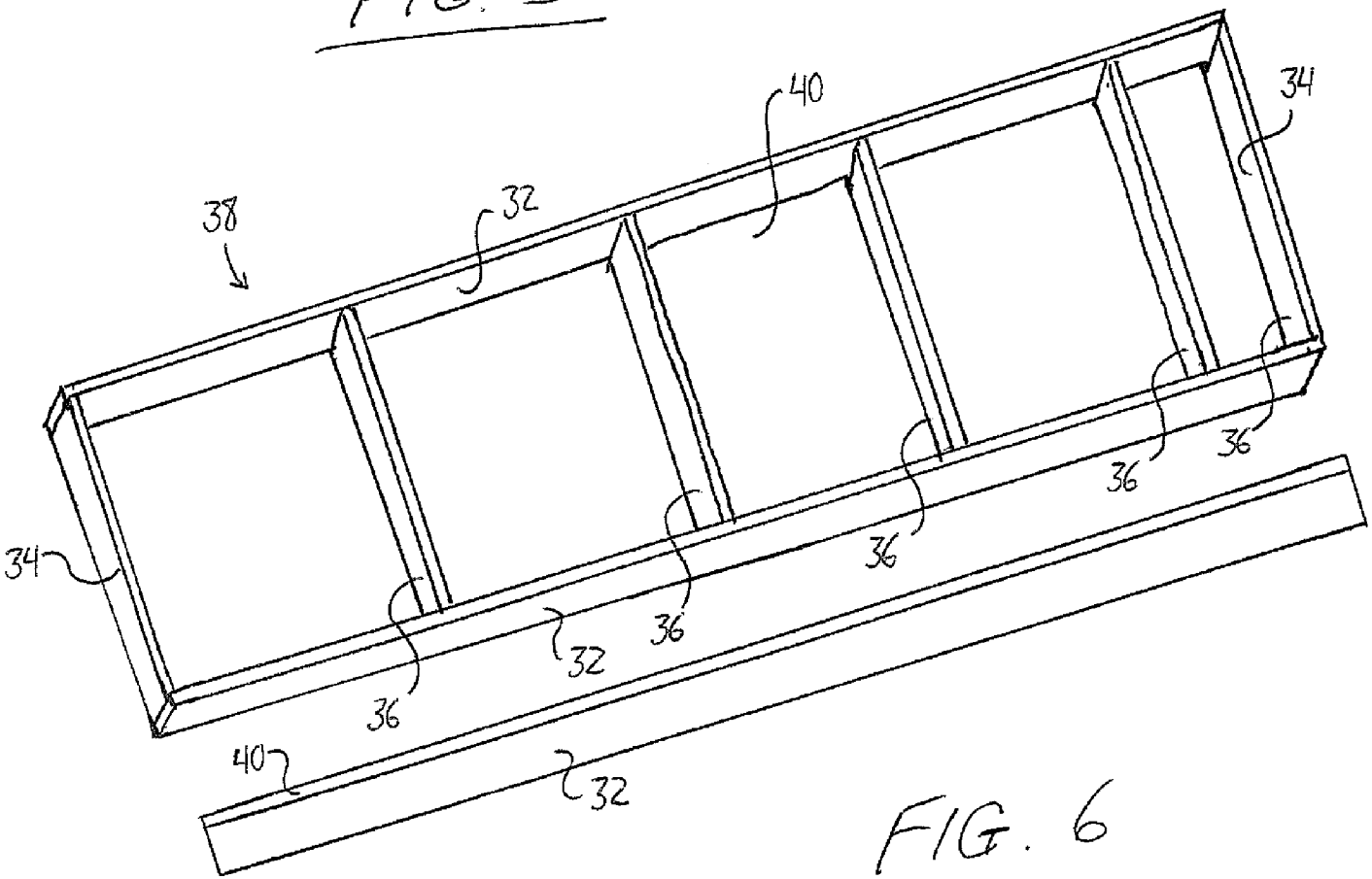
FIG. 5 is a schematic perspective view of assembled frame components of the dock assembly prior to completion thereof by installation of floatation devices.
FIG. 6 is a schematic side elevational view of the dock assembly.

FIG. 5 shows assembled side members 32, end members 34 and cross members 36 of a frame 38 of the dock assembly 20. The perimeter of the dock frame 38 is features the two parallel side members 32 and the two parallel end members 34 perpendicularly interconnecting the side members 32 at opposing ends thereof to give the dock assembly its rectangular shape. A plurality of cross members 36 are spaced along the side members 32 defining the length of the dock frame and are each parallel to the end members 34 to divide the rectangular space inside the perimeter of the dock frame into a number of rectangular compartments. This rectangular space is covered one side by a planar cover 40 spanning the width and length of the dock frame between the end and side members thereof to define the deck of the dock assembly, producing a flat deck surface facing away from the other deck frame members and upward when the deck assembly is installed on the trailer 12. Styrofoam blocks, not shown, are fitted into the compartments formed between the cross-members 36 beneath the deck 40 to act as floatation devices when the deck is lowered onto or placed into a body of water. The blocks can be held in place by fixing support members (not shown) to the side of the frame opposite the deck 40 to span between the adjacent ones of the cross members and end members or span between the side members at locations spaced therealong.

Alternatively, a bottom cover opposite the deck could be fixed in place to cover all or a substantial portion of the dock assembly bottom. It will be appreciated that other flotation arrangements may alternatively be employed, for example by securing air-filled containers defining flotation chambers to the dock assembly beneath the deck. A prototype of the portable dock system was constructed using 2×6 wooden boards for the side, end and cross members, plywood sheets as the deck or top cover and buoyant foam block floats sufficient to float the free end of the dock assembly on a body of water independent of any additional support provided by the lift cable when tensioned. With the dock assembly sufficiently buoyant to float and carry body weights of users and small equipment (canoe, kayak, etc.) on its own without outside support, the need for stilts or anchor legs deployable to engage the river, lake or sea bed. The pivotal connection of the dock to the trailer and the lift provide further resistance to sinking of the dock. It will be appreciated that dock frame and deck structures other than those illustrated may be applied. For example, the deck may be defined by a series of elongate members spanning along a dimension of the deck frame in a common plane and being spaced slightly apart from one another between their lengthwise edges.

Figure 14:
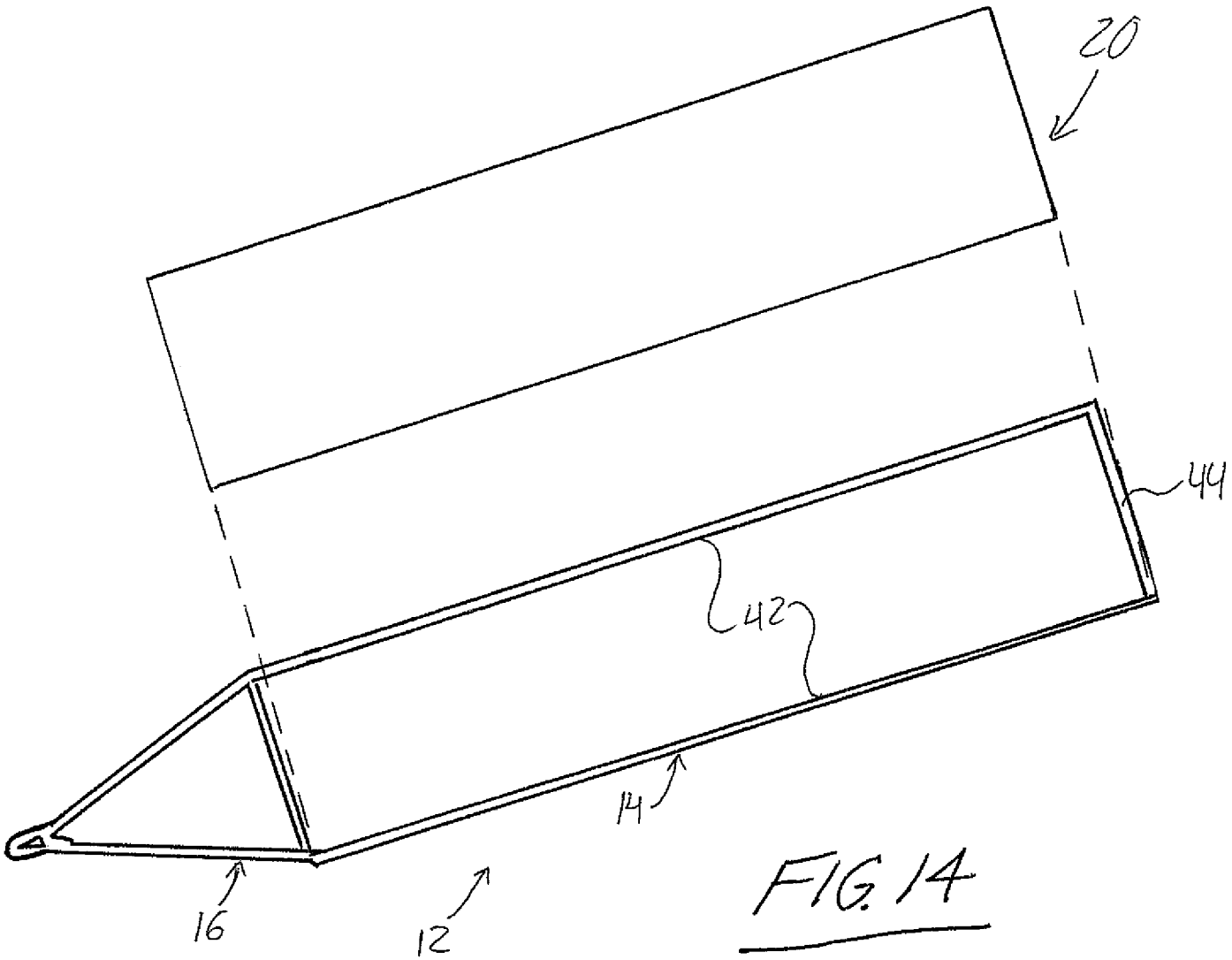
FIG. 14 is a schematic illustration of relative positioning of the dock assembly over the trailer frame for the illustrated embodiments of the portable dock system.

With respect to FIG. 14, the dock assembly preferably has a similar rectangular shape and similar length and width dimensions as the rectangular primary trailer frame 14 so that the side and end members 32, 34 of the dock frame 38 sit atop respective side and end members 42, 44 of the primary trailer frame 14. Referring again to FIG. 1, the width of the dock is slightly less than that of the trailer frame so as to fit between the uprights 28 on the opposite sides thereof without contacting the uprights during pivotal motion of the dock. Although not shown in FIG. 14, the primary trailer frame preferably also includes cross members and additional longitudinal frame members connected to the perimeter defining side and end members to provide strength and rigidity to the trailer frame.

With reference to FIG. 1, each upright or brace 28 of the illustrated embodiment features two legs 46 fixed to a respective one of the side members 42 of the primary trailer frame against an outer face thereof so as to project obliquely upward therefrom in a converging manner. At top ends of the equal length legs 46, they are connected by a cross piece 48 that is oriented parallel to the trailer frame side member 42. A support pulley 50 hangs from the cross piece 48 at a position spaced therealong from each of the legs 46. The uprights are aligned with one another along the lengthwise dimension of the trailer at a position therealong nearer the distal end of the trailer opposite the proximal end to be hitched to a tow vehicle. In the produced prototype, the legs and cross pieces of the upright braces 28 and the trailer frame members are tubular metal lengths fixed together by welding.

Figure 2:
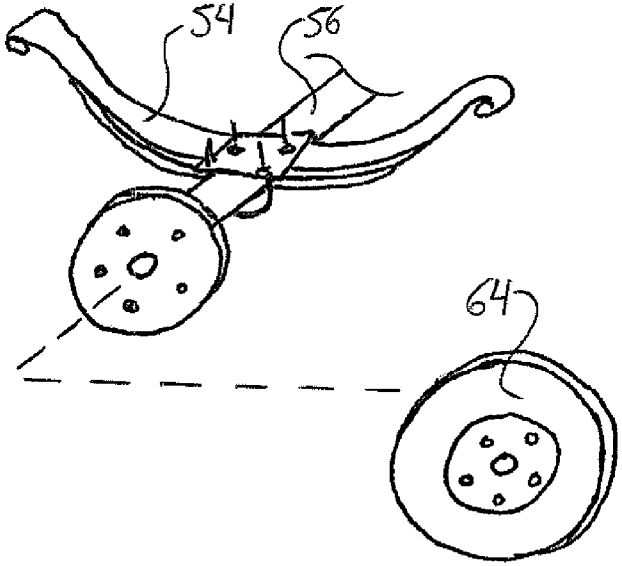
FIG. 2 is a schematic perspective view of one of the wheel assemblies of the portable dock system.
Figure 3:
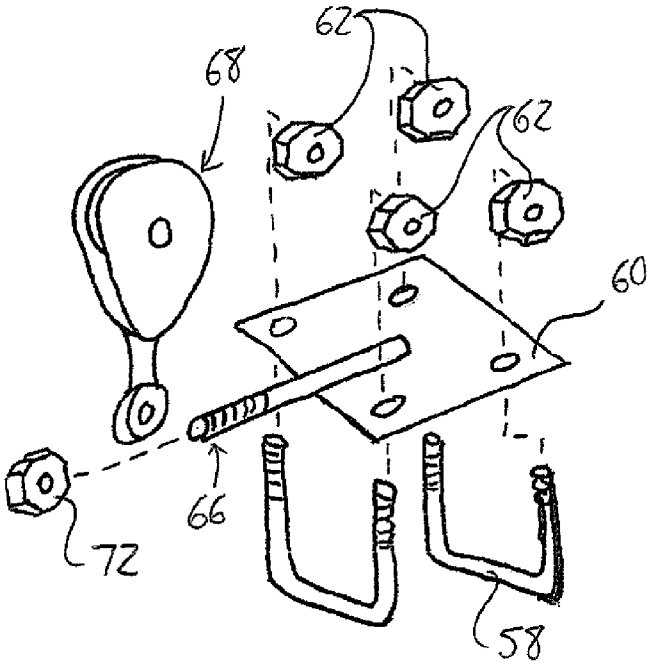
FIG. 3 is a schematic perspective view of an exploded connection of a lift cable guide pulley to one of the wheel assemblies for guidance of a lift cable assembly used to pivot the dock assembly relative to the trailer frame.

Referring to FIGS. 1 and 2, the two upright braces 28 are situated above the trailer's wheel assemblies at the same positions thereas along the side members 42 defining the length of the primary trailer frame 14. A pair of brackets 52 depend downward from each trailer frame side member 42 at spaced apart locations therealong to support a leaf spring 54 in a conventional manner between the brackets 52 beneath the side member 42 to position the longitudinal center of the leaf spring generally centrally between the legs of the upright brace 28. Referring to FIGS. 2 and 3, an axle 56 extending perpendicularly transverse to the trailer's central longitudinal axis is coupled to the bottom of the leaf spring at each side of the primary trailer frame in a known manner by U-bolts 58 that engage about the bottom of axle and extend upward therefrom through a plate mount 60 disposed atop the leaf spring 54 for receipt of nuts 62 on the threaded bolt ends at the top face of the plate mount 60 to clamp the leaf spring and axle together between the plate mount 60 and the curved ends of the U-bolts 58. In a conventional manner, a wheel 64 is rotatably carried at each end of the axle projecting laterally outward from the trailer frame past the respective leaf spring.

However, this connection between the leaf spring suspension and the wheel axle is modified from its conventional structure by the addition of a bolt or threaded shaft 66 fixed to the top face of the plate mount 58 to project laterally outward from the trailer frame toward the respective wheel 64 to situated its threaded end between the wheel 64 and the outward face of the side frame member 42 to which the respective upright brace 28 is secured. A guide pulley 68 features a mounting eye 70 formed in or carried on the housing of the pulley. The guide pulley 68 is fitted over the bolt or threaded shaft 66 from the threaded end thereof projecting from the plate mount 60 and to extend the bolt or shaft through the pulley eye 70 so that a nut 72 can be threaded onto the threaded end to secure the guide pulley 68 on the bolt or shaft directly beneath the respective upright 28 and between the respective wheel 64 and the U-bolt and plate mount coupling assembly securing the axle and respective leaf spring together.

Referring back to FIG. 1, the lift cable assembly 24 features two cables connected together. A first cable 74 has one end fixed to the drum of the lift control winch 26 and slopes downward and rearward from the winch 26 mounted above the a-frame neck 16 of the trailer 12 at a central position thereacross to reach below the a-frame neck 16 at the connection thereof to the primary frame 14 of the trailer. Here, the first cable 74 curves from this downward slope to then travel along the primary trailer frame 14 at a short distance therebelow toward the upright braces 28. To guide the first cable 74 and avoid rubbing thereof against the trailer frame components, a roller 75 of circular cross section in vertical planes extending the lengthwise direction of the trailer 12 is mounted to the bottom of the trailer frame at the connection of the primary frame 14 and a-frame neck 16. When tensioned, the first cable 74 engages against the curved periphery of the roller. The roller is supported for free rotation about its longitudinal axis horizontally and perpendicularly transverse the central longitudinal axis of the trailer. The roller may have flanges of greater diameter than the rest of the roller at its ends to block lateral sliding of the cable off the roller, but preferably also or alternatively has a U-shaped cable retainer secured at its opposite ends to the component or components supporting the roller for rotation just outward from the respective ends of the roller to provide a greater degree of protection against sliding of the cable of the roller.

A second cable 76 of the lift cable assembly 24 is connected at the center of its length to the end of the first cable 74 opposite the lift control winch 26. Each half of the second cable 76 extends from this end of the first cable 74 to engage about a respective one of the guide pulleys 68 below the primary trailer frame 14 but slightly outward therefrom to change direction and from there extend upward past the trailer frame to the support pulley 50 hanging from the top of the respective upright brace 28. Here this half of the second cable 76 engages about the support pulley 50 to again changes direction, this time to extend downward to the dock assembly, where the respective end of the second cable 76 is connected to the dock frame 38. Under rotation of the lift control winch 26 to wrap more of the first cable 74 about its drum, the assembled cables are pulled toward the winch positioned near the proximal, front or towing end of the trailer. Curving around the guide and support pulleys, the second cable 76 has its ends lifted upward to accordingly lift the dock assembly at the connection of the second cable thereto at a distance from the pivot end thereof, which pivots the free end of the dock assembly upward off of and away from the respective distal or rear end of the trailer.

As shown in FIG. 1, an eye bolt 78 may depend downward from a cross member of the primary trailer frame 14 at a central position thereacross at a distance therealong spaced from the uprights 28 and also spaced from the pivotal connection between the trailer and the dock assembly for passage of the first cable 74 through the eye of the eye bolt 78. The second cable 76 then branches off from the three way cable connection 80 at the end of the first cable in a diverging manner on a side of the eyebolt opposite the pivotal connection of the dock assembly, the lines formed by the two halves of the second cable therefore obliquely angling outward from the central longitudinal plane of the trailer toward the respective uprights 28 on opposite sides of the trailer frame. The connection between the different cables may be formed using known cable or wire rope clamps to form a loop at the centre of the second cable and subsequently form a loop at the end of the first cable passing through the first-formed loop in the second cable. The connection 80 of the two cables of the lift cable assembly in the figures are shown schematically without any detail.

Figure 7:
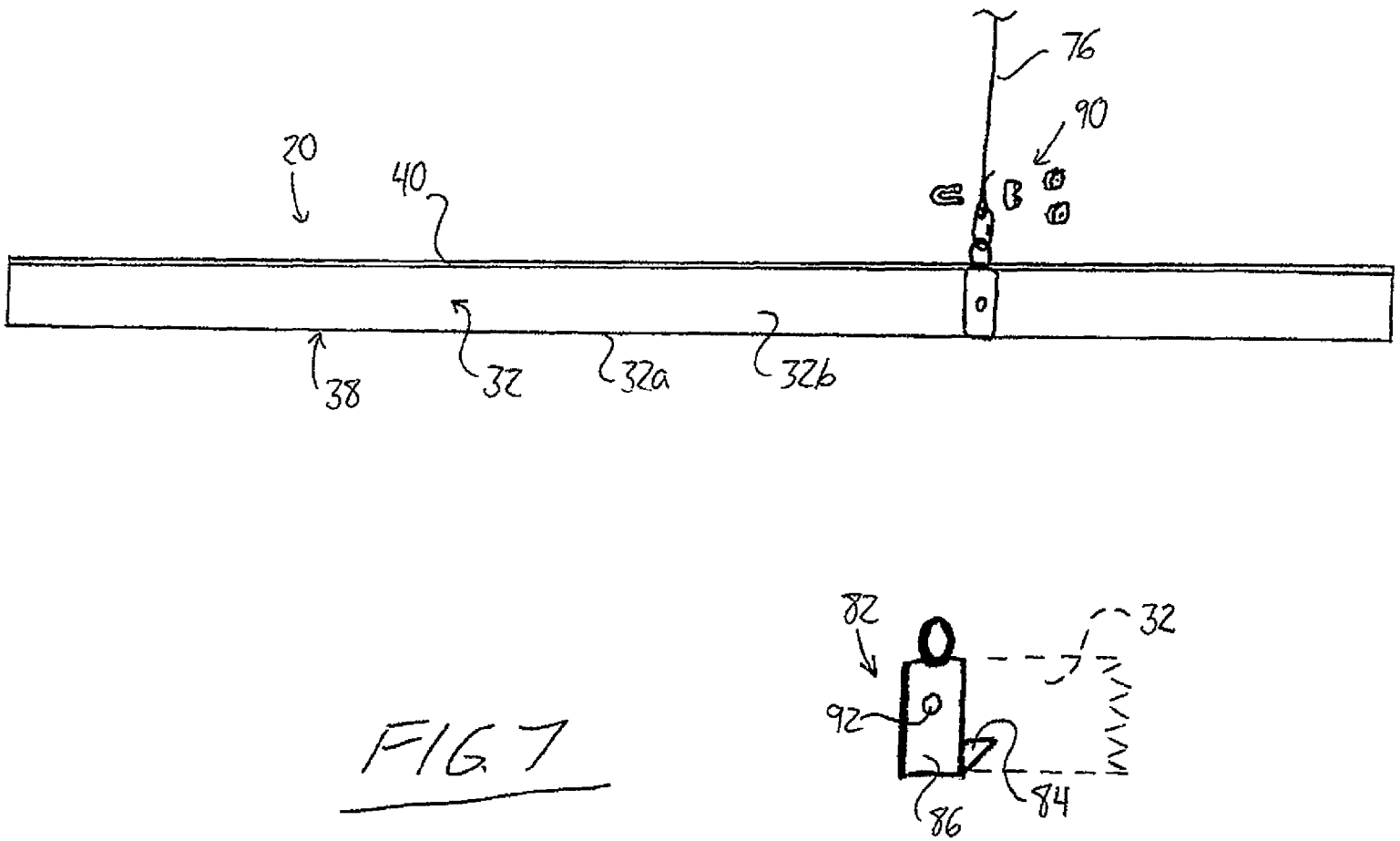
FIG. 7 is features a schematic side elevational views illustrating installation of a connection bracket used to connect the lifting cable assembly to the dock assembly on each side thereof.

FIG. 7 illustrates the connection between the dock assembly and each end of the second cable 76 of the lift cable assembly 24. An L-shaped bracket 82 has two planar legs diverging from one another at a right angle, a first leg 84 projecting in the widthwise direction of the dock frame 38 and a second leg 86 projecting in the along a height or thickness dimension of the dock frame 38. The first leg 84 has its upper face placed flush against the bottom surface 32*a* of a respective one of the dock frame side members 32 and the second leg 86 has its face that faces the side to which the first leg projects placed against the outer face 32*b* of the same dock frame side member 32. A loop, eye or opening is formed at an end of the second leg 86 opposite the first leg. In the embodiment of FIG. 1, the second leg 86 projects past the deck 40 a short distance and has a closed loop fixed to it above the deck 40 near this upper end. In the prototype, a metal loop was welded to a metal right-angle bracket to provide this structure. The metal cable passes through the bracket opening at a loop formed at the end of the cable by folding of the cable end back over itself through the opening for securing back onto itself by a cable clamp 90. The bracket was bolted to the dock assembly 20 by passage of a bolt through a hole 92 in the second leg 86 of the bracket and onward through an aligned hole in the dock frame side member 32 from the outside face 32*b* thereof to the inside face for mating with a nut and washer thereat.

Figure 8:
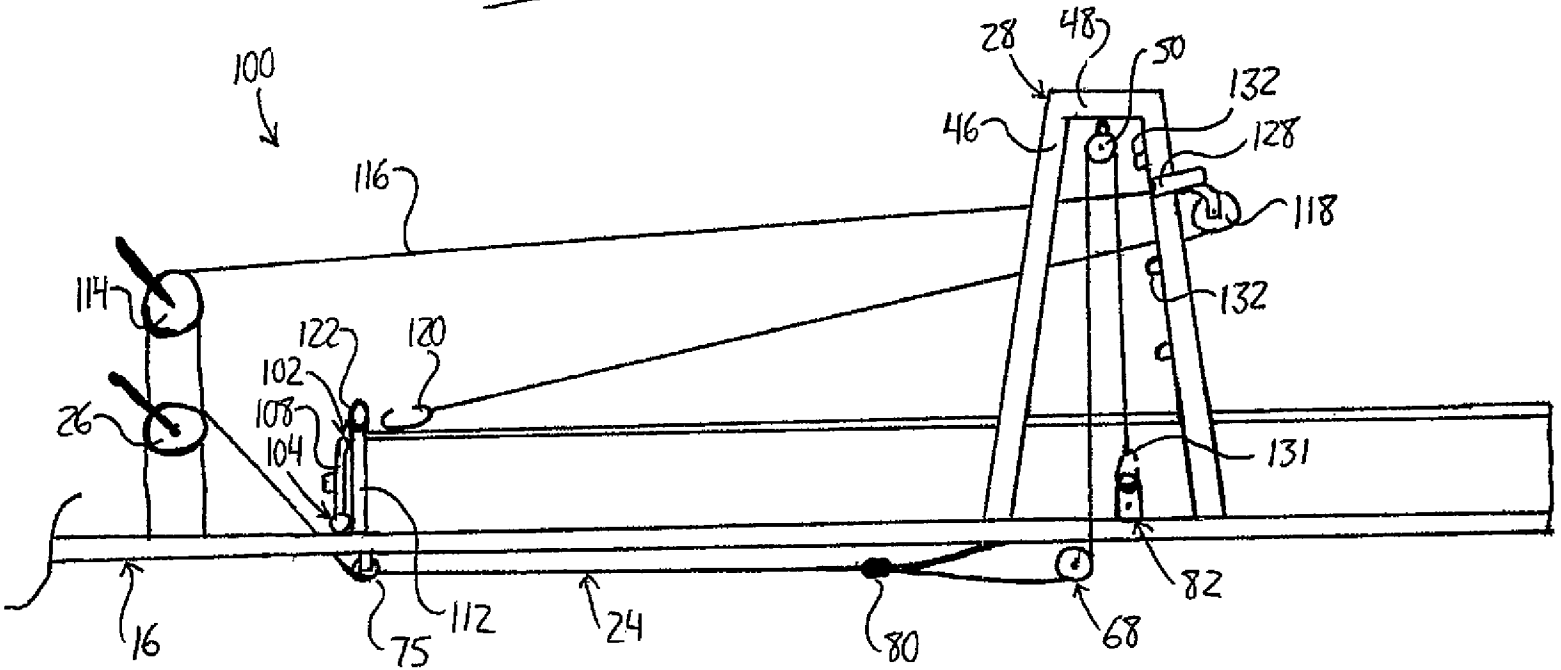
FIG. 8 is a schematic side elevational view of a second embodiment portable docking system wherein the dock assembly and trailer frame are tethered together and the pivotal connection therebetween is releasable for optional floating of the dock assembly away from the trailer frame further out over a body of water.

FIG. 8 shows a second embodiment portable dock system 100 that includes all of the features of the first embodiment, but differs in that the pivotal connection between the dock assembly and the trailer frame is releasable so that with the trailer backed sufficiently into a body of water to float the dock assembly thereon, the pivotal connection can be released to allow floating of the dock assembly further out over the body of water to act as an offshore floating dock or platform. The embodiment has further additional features relating to this added functionality, specifically a second winch and cable combination that acts as a tether to limit the separation between the floating dock assembly and the parked trailer frame to prevent loss of the dock platform, and that is operable to effect both extraction or deployment of the dock assembly from the trailer frame and subsequent retraction of the dock assembly back to the trailer frame for re-establishment of the pivotal connection therebetween for on shore storage, use as a shoreline dock or transport away from the site in which it was being used.

The releasable pivotal connection 102 includes a hinge 104 having one of its plates fixed to a cross beam of the trailer generally situated at the connection of the primary frame 14 and a-frame neck 16. The other plate 108 is pivotal relative to fixed plate the about the hinge axis perpendicularly transverse to the longitudinal axis of the trailer, thereby defining a swivel plate 108. Rigidly secured to the outer face of the end member of the deck frame at the pivot end thereof is a dock securing plate 112 that. To pivotally connect the dock assembly and trailer, with the dock seated flat atop the trailer frame as shown in FIG. 8 to position the securing plate 112 adjacent the hinge 104, the swivel plate is positioned about its pivot axis to extend upward from the trailer frame parallel and adjacent to the securing plate 112 on the dock frame.

At the lateral center of the trailer and dock, there is at least one pairing of holes in the swivel plate 108 and the securing plate 112 that align when the dock is fully seated and the swivel plate is swung against the securing plate at the end of the dock. A connecting pin has a shaft or stern of sufficiently small diameter to pass through these aligned holes, and a head of diameter too large to pass through these holes. The connecting pin shaft is passed through the aligned holes from one side of the face-to-face swivel and securing plates. A locking pin, such as a cotter pin, is subsequently passed through a cross-bore in the connecting pin shaft on a side of the face-to-face swivel and securing plates opposite the connecting pin head. The locking pin dimensions prevent withdrawal of the connecting pin back through the aligned holes until the locking pin is withdrawn from this locking position engaged through the connecting pin shaft. With this pinned connection in place on each side of the docking assembly, the swivel and securing plates are fixed together so that the dock can be pivoted relative to the trailer as described for the first embodiment.

The end member of the dock on which the securing plate may have a hole cut therein in alignment with the hole in the securing plate so that the connecting pin also passes through the end member. In such an arrangement, an opening in the top deck of the dock provides access to this hole in the end member of the dock frame to allow insertion of the connecting pin from the inside face of the end member, or insertion of the locking pin into the connecting pin on this side. Such an opening may be closable so as avoid a tripping hazard in the deck in the form of a permanent access hole. Instead of having the connecting pin passing through the end member of the dock frame, the securing plate may be fixed to this end member in a position spaced therefrom by a short distance so that the connecting pin can be slid into the aligned holes in the plates from the side opposite the dock assembly, and the locking pin then inserted into the connecting pin within this access space between the dock frame and the securing plate fixed thereto. Another alternative is replacement of the removable connecting pin with a stationary pin or shaft fixed to the securing plate to project therefrom away from the dock assembly to align with a hole in the swivel plate when the swivel plate after the swivel plate has been pivoted into an orientation parallel to the securing plate. The shaft thus projects through the hole in the swivel plate when the dock assembly is moved theretoward with the swivel plate held in this orientation. Once the shaft projects through the hole in the swivel plate, the locking pin is then passed through the cross-bore in the shaft on the side of the swivel plate opposite the securing plate.

When the pivotal connection between the dock platform and the trailer is released by removal of the locking pins after entry of the trailer into the body of water to float the dock platform on the water above the primary trailer frame 14, a tether control winch 114 mounted on the a-frame neck 16 of the trailer frame and carried at a distance thereabove. As illustrated in FIG. 8, the tether control winch 114 may be mounted on a same stanchion or upright post as the lift control winch 26 but it alternatively could be mounted on a separate support. Each winch may be manually operated, as represented in the drawings by manual crank handles on the winches, or may alternatively be electrically powered. For example, a prototype has been produced in which the lift control winch is electrically powered by a battery and is carried on a mount that is separate from, and closer to the trailer hitch 18 than, the mount for a manually operated tether control winch.

The tether control winch is operable to pull the dock platform assembly 20 away from the proximal or front towing end of the trailer 12 through winding of a tether control cable 116 about the tether control winch drum. To perform this function, the tether control cable 116 extends from the tether control winch 114 over the trailer frame in the central longitudinal plane thereof, past the disconnected pivot end of the dock assembly 20 to between the uprights 28. After passing between the uprights, the tether cable 116 engages about a tether guide pulley 118 carried on the uprights 28 at a position therebetween above the dock assembly 20. This redirects the tether cable 116 back toward the disconnected pivot end of the dock assembly 20, where a releasable connector 120 fixed to the end of the tether cable 116 opposite the tether control winch 114 connects to an anchor point 122 defined on the dock assembly at or proximate the pivot end thereof at a central position across the dock width. For example, the releaseable connector may be a carabiner clasp and the anchor point may be provided at the example by a steel loop welded to the securing plate 112 adjacent a top edge thereof to project upward from the deck of the dock assembly.

Rotating the tether control winch 114 in the direction needed to wrap more of the tether cable 116 around its drum pulls the anchoring point 122 at the disconnected pivot end of the dock assembly 20 toward the tether guide pulley 118. This pulling of the dock assembly away from the proximal end of the trailer moves the dock's disconnected pivot end toward the uprights 28 and pushes the opposite end of the dock further out over the body of water beyond the distal end of the trailer. As the anchoring point 122 nears or reaches the tether guide pulley 118 along the longitudinal direction of the trailer, the tether control winch can be set to freewheel, thereby allowing more tether cable to be deployed so that the dock can continue moving further outward over the water, the length of the tether control cable determining the how far the dock platform can go relative to the trailer so long as the tether cable remains connected to the dock assembly.

When it is desirable to retract the dock platform back to the trailer, the tether cable is wound onto the tether control winch to draw the disconnected pivot end of the dock assembly back toward the trailer. However, such winding of the tether control cable 116 when engaged about the tether guide pulley 118 will only pull the disconnected pivot end of the dock assembly 20 back to the pulley's location, not fully back to the hinge 104 for reconnection to the swivel plate 108 thereof. Therefore, before winding of the tether control winch 114 to retract the dock platform, either the tether cable 116 is disengaged from around the tether guide pulley 118, if possible, or the tether guide pulley is detached from the uprights 28 and brought to the a-frame neck of the trailer 12 past where the hinge 104 is mounted to the trailer. This way, winding of the tether cable 116 will pull the anchor point 122 at the disconnected pivot end of the dock assembly 20 toward the tether control winch 114 and past the uprights 28 to the hinge 104 for the reconnection of the securing plate 112 on the dock assembly 20 to the swivel plate 108 of the hinge 104 to re-establish the pivotal connection of the dock assembly to the trailer frame.

Figure 9:
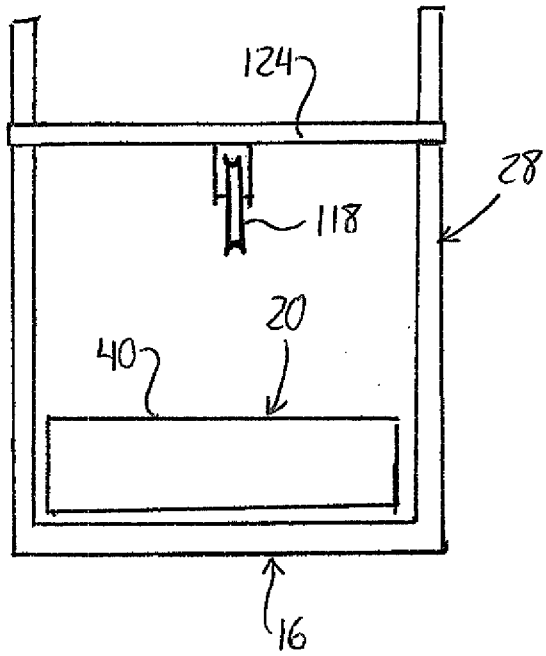
FIG. 9 is a schematic end elevational view of the second embodiment portable docking system showing a tether cable guide pulley installed thereon.
Figure 10:
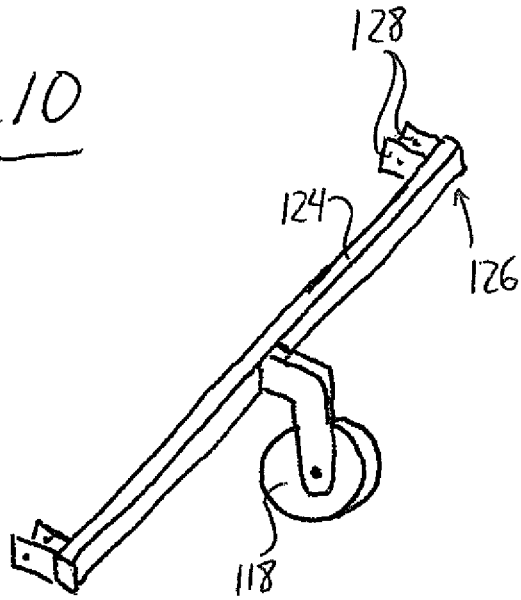
FIG. 10 is a schematic perspective view of a removable pulley bar carrying the tether cable guide pulley.

FIGS. 9 and 10 illustrate the mounting of the tether guide pulley 118 in the illustrated embodiment. The pulley 118 is mounted centrally along a pulley support bar 124 which is placed in a horizontal position spanning between the two upright braces 28 fixed to the trailer frame. At each end of the pulley bar 124, a mounting bracket 126 is formed by a pair of vertically oriented parallel flanges 128 sufficiently spaced apart horizontally to fit a respective one of the two legs of the two upright braces 28 nearest distal end of the trailer frame between them. Aligned holes 130 passing through the planar flanges of each bracket align with a respective through-hole extending horizontally through the respective upright leg to receive a locking pin, for example a cotter pin, for selectively securing the pulley bar in place. Multiple through-hole sets may be provided in the legs of the upright braces 28 to allow selective installation of the pulley bar at different heights above the trailer frame. Other releaseable fastening arrangements could instead be used, such as use of releasable clamps to secure the pulley bar to the uprights.

The illustrated tether guide pulley has the pin or shaft about which the sheave rotates supported on the pulley bar on both side of the sheave, and so if the space between these supports is not sufficient to enable passage of the releasable connector 120 at the end of the tether cable therebetween form disengagement from the pulley, then removal of the pulley bar would be required to change the point toward which the tether cable pulls from being at the uprights to being at the a-frame neck of the trailer. It will be appreciated that a single sided pulley support arrangement could instead allow the tether cable to simply be lifted off the pulley from the unsupported open side thereof, but that such an arrangement would be more prone to unintended separation of the cable from the pulley at other times. Furthermore, having the pulley detachably mounted allows removal thereof when the dock is being used at the shoreline, and not being deployed further out over the water, so as to fully open the space between the uprights to maximize the usable space over the dock and avoid potential personal injury due to collision with the pulley or pulley bar when walking along the deck.

The second embodiment also differs in the connection of the lift cable assembly to the dock assembly, specifically in that another releasable connection 131 is used so that the lift control cable assembly can be detached from the dock assembly when the user wishes to extract the dock assembly from the trailer and deploy it further out over the water. FIG. 8 therefore shows the use of a clasp or carabiner at the ends of the second cable of the lift cable assembly for easily manual disconnection from the loop of the bracket on the dock assembly, and shows a plurality of loops or rings 132 fixed to one of the legs of each upright 28 to provide places where the respective end of the lift cable assembly can be hung using the releasable connector after detachment from the dock assembly to prevent the lift cable from becoming tangled or caught when deploying the dock from the trailer. Hooks or holes in the legs may alternatively be used in place of rings or loops to form hanging sites for the lift cable. FIG. 8 also demonstrates how the lifting bracket of the dock assembly need not necessary be positioned to situate the loop, opening or connection point above the deck of the dock assembly.

If the side member 42 of the dock and the respective upright are tightly spaced, the outer face of the side member 42 may be recessed inward toward the central longitudinal plane of the trailer where the dock's lift connection bracket 82 is mounted so that the bracket does not catch or contact the upright 28 on the respective side of the trailer during movement of the dock assembly therepast during deployment and retraction of the dock assembly. Alternatively, the side mounted connection bracket may be replaced with a suitable connection component mounted atop the deck surface of the dock.

A general summary of the different parts of the second embodiment dock system or unit, and their functions, are provided as follows:

Tether control crank winch 114 is used in combination with the tether guide pulley 118 to eject and load the dock platform forward and backward from the unit, for use of the dock platform as a raft or floating offshore dock.

Lift control crank winch 26 is used in combination with the lift cable support and guide pulleys 50, 68 on both sides to adjust and lift up and down the platform dock when the unit is being used as a stationary dock from the shoreline.

Swivel plate 108 is used to secure the platform dock when the unit is in transport or being used as a stationary shoreline dock, and is detachable from the platform dock.

Securement plate 112 is a plate, of steel for example, permanently attached to the platform dock to secure the platform dock to the swivel plate 108.

Anchor point 122, for example in the form of a steel loop welded to the securement plate 112, is issued as a securement point for the releasable connector 120 and tether cable 116 to pull on when ejecting and loading the platform dock when it is to be used as a raft or offshore platform.

Tether cable 116, for example steel cable line, is used with the tether control winch 114 and selectively with the removable guide pulley 118 system.

Releasable connector 120, for example a steel clasp, is used to connect and disconnect to anchor point 122, for the option of ejecting the platform dock for the use of a raft or offshore platform.

Roller 75, for example a small steel rolling bar, is attached to the trailer frame and is used as a guide for the lift cable line.

Lift cable assembly connector 80, for example as provided by U-clamps forming cooperative loops in two lengths of cable to join the end of one cable to a mid point of the other, joins lift line sections from the lift cable guide pulleys 68 on both left and right sides into one line section then extending to the lift control winch 26.

Lift cable assembly 24, for example using steel cable lines interconnected as described above, is used to elevate the dock platform 20. Sizing of eye bolt 78 to block passage of connector 80 therethrough may limit the winding of the first lift cable to define the maximum elevation of the dock platform. Alternatively, a visual marker may be used in the lift lines to indicate the maximum safe elevation to the operator.

Upright braces 28 include right and left braces fixed to the trailer frame. Each brace serves as the main support for the removable tether guide pulley 118, hanging anchor sites 132, the free end of the dock platform assembly 20, and the lift cable support pulleys 50.

Two undercarriage lift cable guide pulleys 68, right and left, redirect the lift cable lines from below the trailer to above the dock platform.

Pulley support bar 124 and tether guide pulley 118 thereon make possible the ejection of the platform dock for the use of a portable raft through rotation of the same winch used to retract the dock after such use. The tether cable 116 is extended out from the tether control winch 114 and is strung through the tether guide pulley 118 and pulled back and connected to anchor point 122 with the use of releasable connector 120. Before the tether cable is ever used, the dock platform is first elevated to water level to rest (float) through use of the lift control crank 26, which is then released enough to loosen or slack the lift cable 24 so that the releasable connectors 131 at the end of the lift cables can be detached from the brackets 82 on the dock platform. After this, each releasable connector 131 is then attached to a hanging anchor site 132 to prevent any entanglement during the ejection the platform dock using the tether guide pulley 118. Pulley bar 124 is removable and adjustable to different heights using fasteners on each side of the upright braces 28. The guide pulley bar 124 may be normally stored away in a compartment in the dock platform due to its use only during ejection of the dock platform.

Releasable connector 131, for example a steel clasp, is permanently attached to the lift cable but detachable from the respective bracket 82 on the dock platform. After detaching the releasable connector 131 from the respective bracket 82, it is preferably to be attached to a hanging anchor site 132 on the respective upright 28 to prevent line entanglement during ejection of the platform dock.

Hanging anchor sites 132 provided on the main upright braces 28. for example by attachment of loops thereto, are to anchor releasable lift line connector 131 so that this connector and lift line are not loose and free to get caught or tangled when ejecting the platform dock.

Main trailer frame 14, for example made of steel frame members, supports the dock platform when during transport and carries the upright braces for supporting the dock platform during lifting thereof to set the dock angle relative to the trailer frame so as to situate the deck over the water during reversing of the trailer into the water.

Platform dock assembly 20 consists of floatation materials, for example wood and foam. A primary use is as a dock platform to be used when the dock is in a stationary position on a shoreline, and a secondary use is as an offshore platform or raft that can be ejected from the main trailer frame 14. The trailer dock may have compartments therein to store various accessories, for example the pulley bar 124, racks, an umbrella, a ladder, fishing rods, life jackets, paddles, a trolling motor, a cooler, etc).

Lift cable support pulleys 50 are carried on the main upright braces 28 to form part of the dock-elevating pulley system.

Dock lifting brackets 82, for example each defining a loop through the respective end of the lifting cable passes for connection thereto, are attached to respective sides of the dock platform, for example at or proximate the top or bottom thereof as demonstrated by FIGS. 1 and 8.

Although embodiment of FIG. 8 has both a pivoting and detaching dock assembly, it will be appreciated that embodiments using a non-pivoting connection of a dock assembly to a floatable trailer frame could make similar use of a detachable connection to allow optional floating of the dock further outer over the water. Also, the tether need not necessarily be operable for both deployment and retraction, and could alternatively be used for retraction only in an embodiment featuring no tether guide pulley. Releasable hinge or pivot connections of locking structures other than that described above may be used to connect the dock and trailer.

Embodiments of the portable dock system featuring the releasable connection between the dock and the trailer for selective floating of the dock out over the water outwardly past the distal end of the trailer may include a separate walkway or deck piece presenting a planar upper surface and that can be laid or removably mounted in a pivotal manner atop a round piece of tubing fixed to trailer frame at the neck thereof so as to extend from this end to the disconnected pivot end of the deployed dock assembly adjacent the distal end of the trailer frame to form a walkway or deck length extending along the longitudinal direction of the trailer from the neck thereof to the dock. This way, if the dock is only partly extracted from the trailer so as to position its disconnected pivot end at or proximate the distal end of the trailer frame so that the dock extends further past the distal end thereof than it does when secured to the pivotal connection, the walkway piece presenting a planar upper surface can be installed atop the trailer neck and the disconnected pivot end of the dock assembly to extend the effective length of the dock. Situating the end of the walkway piece opposite the dock on a curved surface, as presented by the arcuate upper portion of a round tube's periphery, allows the walkway piece to automatically take on the same angle relative to the trailer frame as the floating dock.

Figure 11:
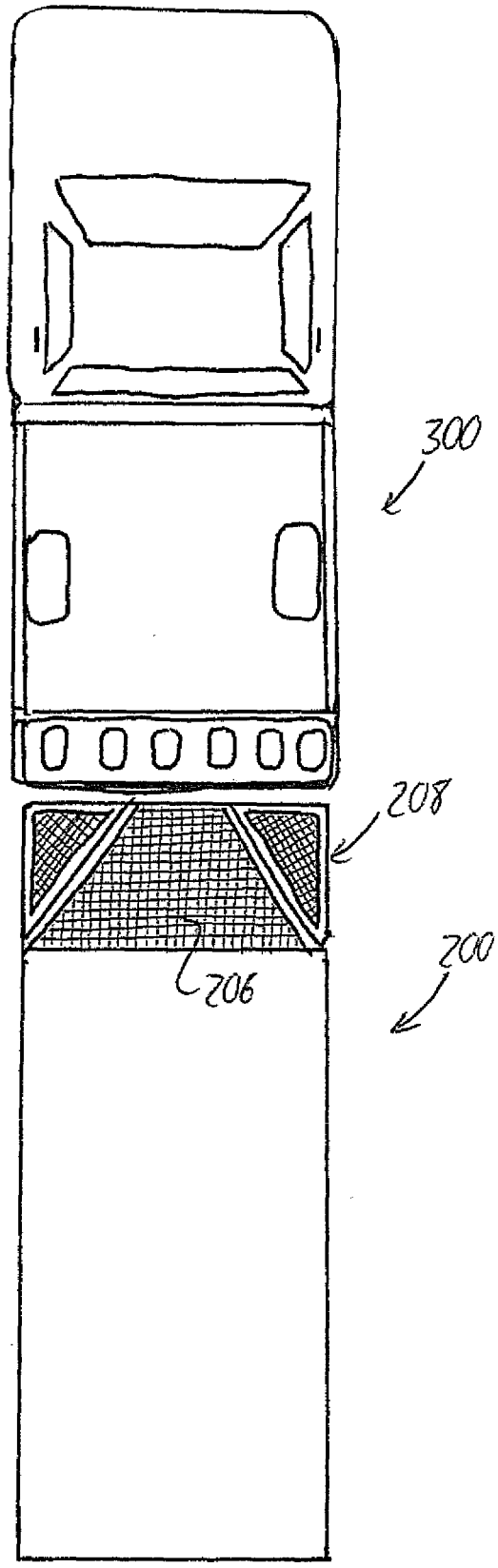
FIG. 11 is a schematic overhead plan view of a third embodiment portable docking system having a cover disposed over the a-frame neck of the trailer to form a walkway from the rear of a towing vehicle to the dock assembly carried on the trailer frame rearward of the a-frame neck.
Figure 12:
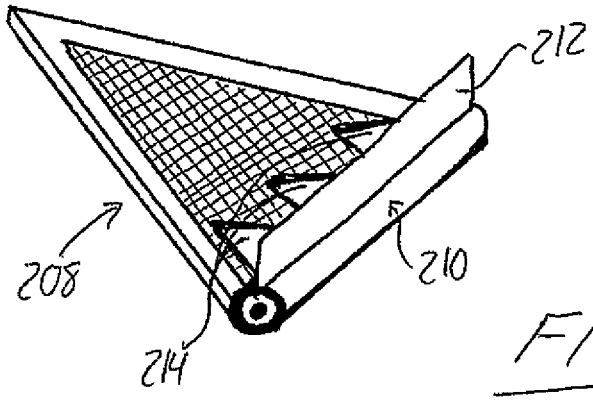
FIG. 12 is a schematic perspective view of one of two walkway extensions pivotally secured to the a-frame neck of the third embodiment docking system to fold down and extend a surface area of the walkway between the towing vehicle and dock assembly after the vehicle has been parked with the dock assembly out over the water.
Figure 13:
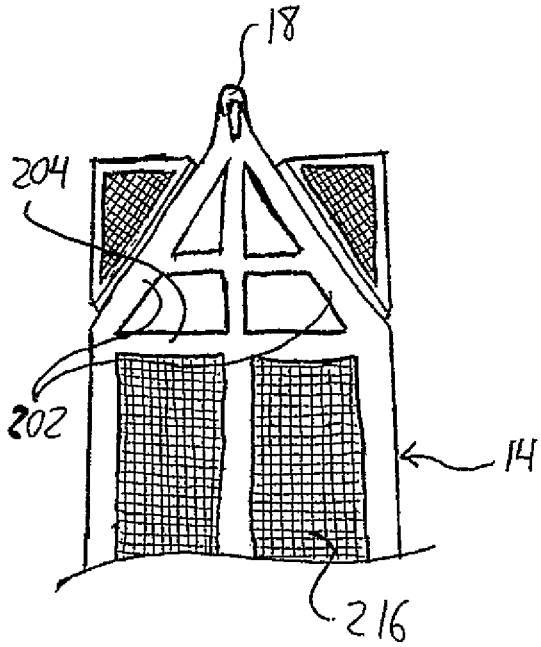
FIG. 13 is a schematic overhead plan view illustrating connection of the walkway extensions to the a-frame neck of the trailer frame.

FIGS. 11 to 13 schematically illustrate a third embodiment portable dock system 200. With references to FIG. 13, the trailer of the system features a rectangular primary frame 14 and a-frame neck 16 like those of the preceding embodiments, and again features a dock assembly carried over and sized generally equally to the primary trailer frame 14. The dock assembly may be pivotally and/or detachably mounted atop the trailer frame as described for the preceding embodiments, but is shown without detail in FIG. 11 for ease of illustration. Referring to FIG. 13, the a-frame neck 16 of the trailer features two converging side members 202 having ends fixed to the end of the rectangular primary frame 14 that is opposite the distal rear end of the trailer. The converging side members converge forwardly away from the rectangular primary frame 14 to give the a-frame its narrowing shape from a wide end that is equal to the width of the rectangular primary frame 14 to a narrow apex end at which the hitch coupling component is mounted to provide a socket for engaging the hitch ball of a towing vehicle 300. A cross member 204 extending perpendicularly transverse to the longitudinal dimension of the rectangular primary frame 14 spans between the converging side members 202 at the ends thereof adjacent the primary frame 14. This may be a common cross beam shared by the coupled ends of the primary frame and trailer neck, as illustrated in FIG. 13.

As shown in FIG. 11, a metal mesh plate cover 206 is fixed atop the a-frame trailer neck 16 to span from one of the converging side walls to the other from adjacent the trailer coupling component 18 rearward to adjacent the cross member 204 at the connection of the primary frame and neck of the trailer. Where the dock assembly uses the pivotal connection from either of the first two embodiments, the plate cover 206 stops short of the hinge carried on the cross beam at the juncture of the two trailer sections to leave room for operation of the hinge to pivot the dock assembly, and is cut to fit around any post or upward projecting mounting member on which the one or more winches may be carried on the trailer neck. Spanning between the converging side members 202 from near the apex thereof to near the opposite ends thereof, the a-frame cover plate 206 has an outer shape of a truncated isosceles triangle. With reference to FIG. 11, when a truck is used as the towing vehicle 300 to transport the portable dock system and position it at the shoreline of a body of water, the a-frame cover 206 forms a walkway onto which a person can directly step down from the box, bed or platform of the truck to travel rearwardly onward to onto the dock assembly instead of having to first transition from the truck to the ground and then back upward from the ground onto the trailer or portable dock, or having to use the narrow frame members of the trailer neck as a transition walkway from the vehicle to the dock assembly and risk a potentially harmful fall from these narrow members should the person lose their balance. As shown in the drawings, use a tailgate-equipped pickup truck with the dock system is particularly advantageous, as the folded down tailgate spans at least a portion of the gap between the truck bed and the a-frame cover plate 206 to provide a more complete walkway from the bed to the dock.

FIG. 12 shows a triangular extension plate 208 for pivotal mounting to a respective one of the converging side members 202 of the a-frame trailer neck 16. One extension plate 208 is pivotally mounted to each converging side member 202 at an outward facing side thereof facing away from the other one of these side members 202. The extension plates 208 have triangular shapes that are complimentary with the truncated triangular shape of the a-frame cover plate 206 so that the a-frame neck and the extension plates collectively define a rectangular area aligning with that of the dock assembly and primary trailer frame 14 when the extension plates project outward from the a-frame's converging side members 202 parallel to the cover plate 206 spanning therebetween. The extension plates thus extend the width of the walkway formed by the covered a-frame neck between the towing vehicle and the dock assembly so that the walkway extends the full width of the dock assembly when the extension plates are pivoted into coplanar positions flush with the plate cover on the a-frame neck of the trailer. This way, the extended walkway provides adequate surface area available for stepping onto from the truck bed or tow vehicle cargo space even in embodiments having one or more winches mounted on the trailer neck near the proximal end of the trailer.

The extension plate 208 of FIG. 12 features a triangular piece steel mesh reinforced with solid plating along two of its side edges. The third side edge has a length of rigid tubing 210 fixed thereto to create a cylindrically round bore extending along this side edge, into which a pair of pins carried on the respective one of the a-frame's converging side members 202 to extend therealong just outward from the outer face thereof can extend from opposite ends of the tube 210, thereby forming a hinge or pivotal joint between the extension plate 208 and the respective a-frame side member 202 for pivoting of the extension plate about an axis parallel and adjacent to this side member. A rectangular plate 212 fixed to the plate to extend perpendicularly away from one of its faces adjacent and along the side edge to which the tube is fixed blocks pivoting of the extension plate 208 downwardly past it's walkway extending position parallel to the a-frame cover plate 206 by contact with the outer face of the respective a-frame side member 202 upon pivoting of the extension plate into this position. Triangular ribs or braces 214 are shown as being fixed between the rectangular blocking plate 212 the triangular extension plate 208 to reinforce the rigid connection therebetween.

When transport of the portable dock system 200 is required, the extension plates 208 are pivoted up out of their walkway extending in-use positions coplanar with the a-frame cover plate 206 to pivot over the respective a-frame side members 202 onto the a-frame cover plate 206 to lie thereon in stowed or storage positions. This way, the a-frame neck of the trailer is returned to its normal tapered or triangular shape in plan, narrowing away from the primary trailer frame 14 to allow the necessary pivoting or swiveling of the trailer about the upright axis of the vehicle's hitch ball during transport.

As shown in FIG. 13, an additional cover plate or series of cover plates 216 may be mounted atop the rectangular portion 14 of the trailer in a fully or partially covering manner so that when the dock is partially deployed from atop the trailer to extend further out over the water, the cover plate(s) on the rectangular portion extend the walkway further toward the dock from the A-frame portion 16 of the trailer. Accordingly, the effective overall length of dock provided by the inventive apparatus may be further increased by partially deploying the dock from the trailer so as to project out from the trailer frame to provide a generally continuous walkway or platform from the connection of the trailer to the vehicle to the distal end of the partially deployed dock lying partly over the trailer frame and partly over the water past the end of the trailer frame. Where installed atop the rectangular primary frame portion, the additional cover plates preferably extend the full width between the said members thereof to provide a useable walkway space of maximum width, although configurations extending less than the full width or less than the full length of the primary frame are also within the scope of the present invention.

It will be appreciated that the extension and cover plates need not necessarily be of a metal mesh or grate-like configuration and are not limited to metal, and may be alternatively be solid plates or boards. However, a mesh structure is lighter than a solid plate of the same material and also allows water to drain through the openings when the extension plates are deployed, thereby better keeping them dry and accordingly less slippery. Extension plates may similarly be used to define an extended walkway between the cargo hold of a truck or van acting as the towing vehicle and a rearward portion of a trailer regardless of whether that portion of the trailer carries a pivotal dock assembly using floats or stilts, a detachable dock platform, an open top cargo area, or a cargo enclosure openable from the top or forward facing end thereof.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A portable dock system comprising:

a trailer frame extending in a longitudinal direction between proximal and distal ends;

a coupling component mounted to the trailer frame proximate the proximal end thereof for selective coupling of the trailer frame to a tow vehicle;

a pair of wheel assemblies mounted to the trailer frame between the proximal and distal ends at a distance from the proximal end to rollably support the trailer frame for towing by thereof by the towing vehicle;

a dock assembly carried on the trailer frame and comprising a deck surface extending in the longitudinal direction above the trailer frame from a pivot end of the dock assembly adjacent the proximal end of the trailer frame to an opposite free end of the dock assembly adjacent the distal end of the trailer frame, the pivot end of the dock assembly being pivotally mounted to the trailer frame for pivotal movement about an axis transverse to the trailer frame to allow lifting and lowering of the free end of the dock assembly relative to the trailer frame;

floats mounted on the dock assembly below the deck surface thereof to float the dock assembly under entry of the floats into a body of water;

a lift control winch mounted on the trailer frame adjacent the proximal end thereof;

at least one upright mounted on the trailer frame between the lift control winch and the distal end of the trailer frame at a distance from the lift control winch along the longitudinal direction; and a lift line extending from the lift control winch, passing over at least one line support on the at least one upright and extending downward from the line support to at least one lift connection with the dock assembly so as to lift and lower the free end of the dock assembly relative to the trailer frame under rotation of the lift control winch in opposite directions.

2. The portable dock system according to claim 1 wherein the lift line passes under the dock assembly between the lift control winch and the at least one upright.

3. The portable dock system according to claim 1 wherein the lift line extends below the dock assembly from the pivot end thereof to the at least one upright.

4. The portable dock system according to claim 1 wherein the at least one upright comprises two uprights mounted to the trailer frame on opposing sides of the dock assembly.

5. The portable dock system according to claim 4 wherein the lift line comprises a first line section fixed to the lift control winch and second line sections fixed to an end of the first line section opposite the lift control winch and diverging outward therefrom toward the uprights on the opposing sides of the dock assembly.

6. The portable dock system according to claim 1 wherein the at least one upright is positioned at a location of the wheel assemblies along the longitudinal direction, the wheel assemblies carrying at least one line guide about which the lift line extends from below the dock assembly to the at least one line support of the at least one upright.

7. The portable dock system according to claim 6 wherein the at least one line guide is mounted to at least one connector that interconnects at least one suspension member of the wheel assemblies to an axle of the wheel assemblies.

8. A portable dock system comprising:

a trailer frame extending in a longitudinal direction between proximal and distal ends;

a coupling component mounted to the trailer frame proximate the proximal end thereof for selective coupling of the trailer frame to a tow vehicle;

a pair of wheel assemblies mounted to the trailer frame between the proximal and distal ends at a distance from the proximal end to rollably support the trailer frame for towing by thereof by the towing vehicle;

a dock assembly carried on the trailer frame and comprising a deck surface extending in the longitudinal direction above the trailer frame from a pivot end of the dock assembly adjacent the proximal end of the trailer frame to an opposite free end of the dock assembly adjacent the distal end of the trailer frame, the pivot end of the dock assembly being pivotally mounted to the trailer frame for pivotal movement about an axis transverse to the trailer frame to allow lifting and lowering of the free end of the dock assembly relative to the trailer frame, and also being releasable from the trailer frame;

floats mounted on the dock assembly below the deck surface thereof to float the dock assembly under entry of the floats into a body of water;

a tether control winch mounted on the trailer frame and a tether line extending between the tether control winch and a tether connection on the dock assembly, wherein release of the pivot end of the dock assembly from the trailer frame when the trailer is deployed into a body of water to float the dock assembly thereon allows deployment of the dock assembly away from the proximal end of the trailer, and rotation of the tether control winch facilitates subsequent retraction of the dock assembly back toward the proximal end of the trailer frame after said deployment; and a tether guide mounted to the trailer frame at a position that is nearer to the distal end of the trailer frame than the tether control winch and also nearer to the distal end of the trailer frame than the tether connection is when the pivotal end of the dock assembly is secured to the trailer frame, the tether line being removably engagable about the tether guide to change a pulling direction in which the tether connection would be pulled by rotation of the tether control winch in a single rotational direction when the tether connection is situated between the tether control winch and the tether guide in the longitudinal direction.

9. The portable dock system according to claim 8 wherein the tether guide is realeasably mounted to the trailer frame for selective installation in an operational position thereon.

* * * * *